US008025717B2

(12) United States Patent
Dries et al.

(10) Patent No.: US 8,025,717 B2
(45) Date of Patent: Sep. 27, 2011

(54) PROCESS TO SEPARATE PARTICLES FROM A PARTICLES-CONTAINING GAS STREAM

(75) Inventors: Hubertus Wilhelmus Albertus Dries, Amsterdam (NL); Kee-Khoon Foo, Amsterdam (NL); Ferdinand Johannes Adriaan Geiger, Amsterdam (NL); Michiel Alexander Regelink, Amsterdam (NL)

(73) Assignee: Shell Oil Company, Houston, TX (US)

( * ) Notice: Subject to any disclaimer, the term of this patent is extended or adjusted under 35 U.S.C. 154(b) by 194 days.

(21) Appl. No.: 12/377,701

(22) PCT Filed: Aug. 16, 2007

(86) PCT No.: PCT/EP2007/058505

§ 371 (c)(1),
(2), (4) Date: Jul. 9, 2009

(87) PCT Pub. No.: WO2008/020051

PCT Pub. Date: Feb. 21, 2008

(65) Prior Publication Data

US 2010/0132557 A1 Jun. 3, 2010

(30) Foreign Application Priority Data

Aug. 18, 2006 (EP) ..... 06119145

(51) Int. Cl.
*B01D 45/12* (2006.01)

(52) U.S. Cl. ..... 95/269; 95/271; 55/342.2; 55/448; 55/315; 55/342; 55/345; 55/343; 55/346; 55/466; 422/139; 422/147; 96/216; 96/219; 96/301; 423/239.1

(58) Field of Classification Search ..... 55/342.2, 55/448, 315, 342, 345, 343, 346, 466; 95/269, 95/271; 96/216, 219, 301
See application file for complete search history.

(56) References Cited

U.S. PATENT DOCUMENTS

| | | | | |
|---|---|---|---|---|
| 4,810,264 | A * | 3/1989 | Dewitz | 48/210 |
| 4,964,885 | A * | 10/1990 | Wieser-Linhart | 95/66 |
| 4,971,767 | A * | 11/1990 | Ludwigsen et al. | 422/144 |
| 5,690,709 | A | 11/1997 | Barnes | 55/348 |
| 6,551,565 | B2 * | 4/2003 | Confuorto et al. | 423/239.1 |
| 7,048,782 | B1 * | 5/2006 | Couch et al. | 95/269 |
| 7,597,748 | B2 * | 10/2009 | Borley | 95/271 |
| 7,648,544 | B2 * | 1/2010 | Dewitz et al. | 55/448 |
| 2004/0079057 | A1 * | 4/2004 | Sechrist et al. | 55/348 |
| 2004/0211704 | A1 * | 10/2004 | Espeillac et al. | 208/106 |

(Continued)

FOREIGN PATENT DOCUMENTS

| | | |
|---|---|---|
| EP | 360360 | 3/1990 |
| WO | WO03078544 | 9/2003 |
| WO | WO2004009244 | 1/2004 |
| WO | WO2005002711 | 1/2005 |

*Primary Examiner* — Jason M Greene
*Assistant Examiner* — Dung H Bui
(74) *Attorney, Agent, or Firm* — Charles W. Stewart

(57) ABSTRACT

Process to separate particles from a particles-containing gas stream, by subjecting the particles-containing gas stream to a centrifugal separation step, wherein the particles-containing gas stream is separated in a gas rich flow and a particles-rich flow and wherein the particles-rich flow is cooled from a temperature in the range from 600 to 800° C. to a temperature in the range from 200 to 450° C. before it is subjected to a second separation step, wherein particles are separated from the particles-rich flow.

13 Claims, 1 Drawing Sheet

U.S. PATENT DOCUMENTS

2005/0238548 A1* 10/2005 van Egmond et al. ..... 422/146
2006/0096455 A1 5/2006 Couch et al. ..... 95/269
2006/0144231 A1* 7/2006 Borley ..... 95/271
2010/0192815 A1* 8/2010 De Siqueira ..... 110/238

* cited by examiner

PROCESS TO SEPARATE PARTICLES FROM A PARTICLES-CONTAINING GAS STREAM

PRIORITY CLAIM

The present application claims priority of European Patent Application No. 06119145.8 filed 18 Aug. 2006.

FIELD OF THE INVENTION

The invention relates to a process to separate particles from a particles-containing gas stream. The invention furthermore relates to an assembly comprising a cyclone separator, wherein particles an be efficiently separated from a gas-particles mixture. In many processes particles-containing gas streams exist that require separation of the particles from such gas streams. One of such processes is, e.g., a fluid catalytic cracking (FCC) process.

BACKGROUND OF THE INVENTION

Fluid catalytic cracking (FCC) processes and the related plants wherein hydrocarbon feedstocks are catalytically cracked are well known in the art. In FCC processes a preheated hydrocarbonaceous feedstock of a high boiling point range is brought into contact with a hot cracking catalyst in a riser. The feed is cracked into lower boiling products, such as gas, LPG, gasoline, and cycle oils. Furthermore, coke and non-volatile products deposit on the catalyst resulting in a spent catalyst. The riser exits into a separator wherein the spent catalyst is separated from the reaction products. In the next step the spent catalyst is stripped with steam to remove the non-volatile hydrocarbon products from the catalyst. The stripped catalyst is passed to a regenerator in which coke and remaining hydrocarbonaceous materials are combusted and wherein the catalyst is heated to a temperature required for the cracking reactions. Hereafter the hot regenerated catalyst is returned to the riser reactor zone.

FCC regenerators are generally equipped with first and second stage cyclones. These are normally mounted inside the regenerator vessel. In these systems the outlet duct of the first stage cyclone is coupled directly to the inlet duct of the second stage cyclone. An example is given in "Fluid Catalytic Cracking: Technology and Operation", Joseph W. Wilson, PennWell Publishing company, 1997, ISBN 0-87814-710-1, page 183-185. The cyclone separation step results in a gas rich overflow and a solids rich underflow. The solids of the underflow are directed back to the regenerator vessel.

The overflows of these separators are usually collected in a gas collection chamber, and are called regenerator flue gases. The regenerator flue gas still contains fine catalyst particles. From an environmental standpoint it is undesired to discharge this gas untreated. Therefore, third stage separators (TSS) have been utilized for many years to separate catalyst fines from the regenerator flue gas. Several designs are available. The most widely used design is the Shell separator, which was developed by Shell to protect turboexpanders from catalyst particles in the flue gas. The separator consists of a vessel which contains numerous swirl tube separators. These separators are small axial flow cyclones. Flue gas entering the separator tube passes through the swirl vanes which imparts a spinning motion to the gas flow. The resulting forces move the catalyst particles to the tube wall where they are separated from the gas stream. These swirl tube separators and are for example described in "Fluid Catalytic Cracking: Technology and Operation", Joseph W. Wilson, PennWell Publishing company, 1997, ISBN 0-87814-710-1, page 168-170. The separated particles fall through the bottom of the tubes and are collected in the conical bottom of the separator vessel. The separated particles are discharged from the vessel together with a small quantity of the flue gas. This particles-rich flow is also referred to as the TSS underflow. This TSS underflow is then routed to an underflow separator, or a so-called fourth stage separator (FSS). The TSS overflow is routed to the stack.

Although the TSS has been used as an effective device to remove catalyst fines from the regenerator flue gas, emission to stack is also largely influenced by the catalyst loss from the FSS. In the FSS particles are for instance separated by a so-called 4th stage cyclone. The separation results in a gas overflow that is directed to the stack and particles that are generally removed as waste material.

The basic mechanism for particle separation in gas cyclones is that due to circular motion a centrifugal force pulls the particle against the wall, and at the wall the boundary layer carries the separated particle to the dust outlet. In the case of small particles the centrifugal force may be smaller than the drag force of the particles and thus the separation of these particles can be difficult. However, these small particles are often found in the coarse fraction, even when cyclones are not suitable for separating such small particles. Studies have revealed that some small particles may form larger aggregates, or agglomerates, where particles are interlinked in a stable formation. The small particles in the aggregates stick together due to inter-particles forces, e.g. van der Waals forces, electrostatic forces and capillary forces (see for example "Gas Cyclones and Swirl Tubes: principles, design and operation", A. C. Hoffmann and L. E. Stein, Springer, 2002, ISBN 3-540-43326-0 and S. Obermair et al, Powder Technology 156 (2005) 34-42). To optimise the separation of such small particles it is desirable to retain the agglomerates from one separator when they are fed to a further separator. This may be the case in transporting the TSS underflow to the FSS.

SUMMARY OF THE INVENTION

It is an object of the present invention to provide a process and an apparatus with improved separation efficiency, which results in a flue gas having a low solids content.

It has now been found that when a particles-containing gas stream is first passed through a centrifugal separation step, and the resulting particles-rich flow is cooled the agglomerates that are formed do not disintegrate and separation becomes more effective. Accordingly, the present invention provides a process to separate particles from a particles-containing gas stream, by subjecting the particles-containing gas stream to a centrifugal separation step, wherein the particles-containing gas stream is separated in a gas rich flow and a particles-rich flow and wherein the particles-rich flow is cooled from a temperature in the range from 600 to 800° C. to a temperature in the range from 200 to 450° C. before it is subjected to a second separation step, wherein particles are separated from the particles-rich flow.

DETAILED DESCRIPTION OF THE INVENTION

Figure 1:
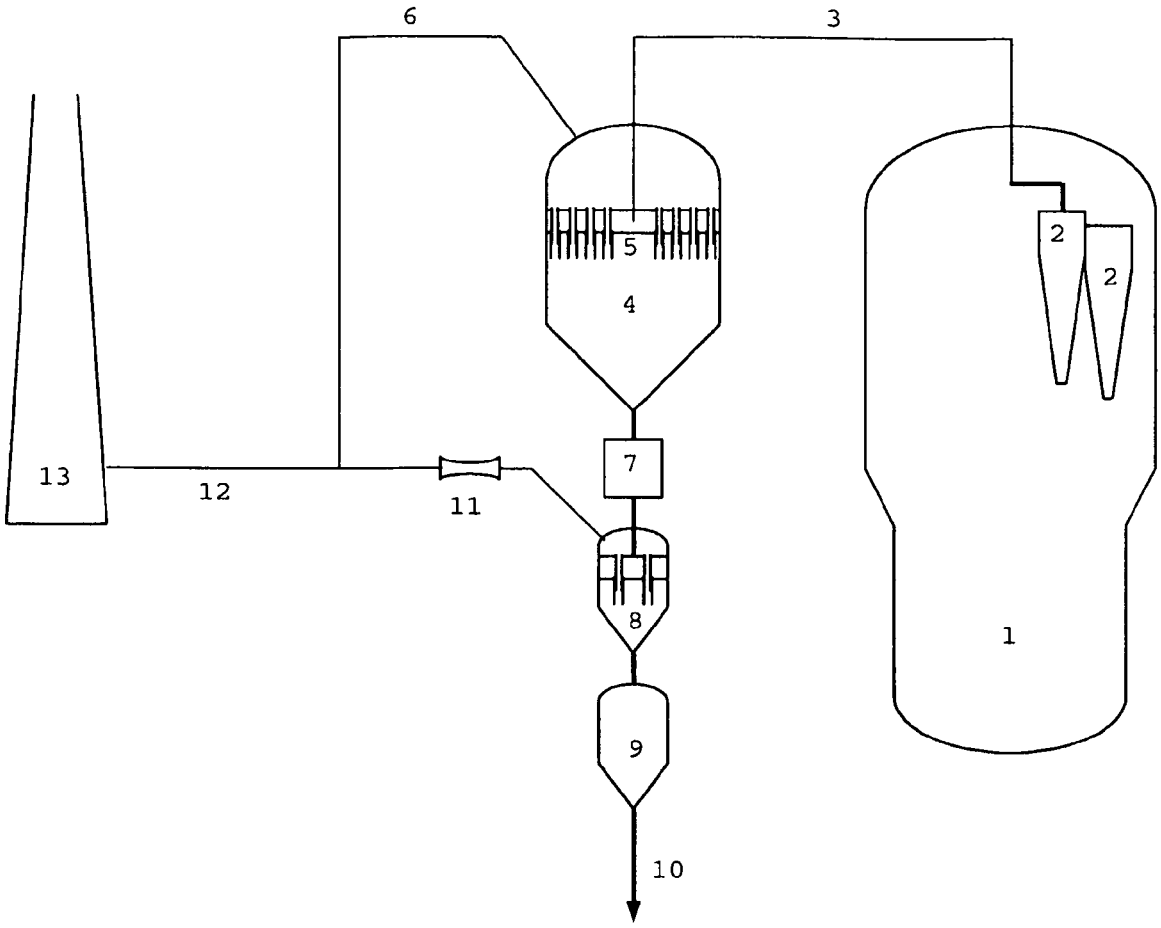
FIG. 1 shows a schematic representation of a fluid catalytic cracking flue gas cleaning system wherein a preferred embodiment of the assembly according to the present invention is integrated.

Applicants found that the agglomerates of particles that are being formed in the centrifugal separation step remain intact when they are cooled, resulting in an improved separation in total and thus in a flue gas having a lower solids content. With centrifugal separation step a separation step is meant wherein a centrifugal force pulls the particles against the wall of a separator due to circular motion, and at the wall the boundary layer carries the separated particles to the dust outlet. Normally, such a separation step is performed in a cyclone separator. These cyclone separators can have a helical inlet, an axial inlet or a spiral inlet. In the case of a cyclone separator with an axial inlet, these separators are also referred to as swirl tube separators. Not only remain the agglomerates intact, but cooling even may improve agglomeration when going from the centrifugal separation step to the second separation step. With the decrease in temperature from a temperature in the range from 600 to 800° C. to a temperature in the range from 200 to 450° C., the gas density may increase by nearly a factor 2, resulting in a denser stream. Applicants found that when the stream is denser, the particles move closer to each other and catalyst fines tend to be more adhesive to each other, resulting in more agglomerates.

Cooling can be performed in any way known by the skilled person, like for example cooling with air along a pipe, cooling with water or by making use of an heat exchanger. Preferably, cooling with air along an extended pipe is used for cooling. More preferably, finned piping is being used as pipe for cooling with air. Finned piping is preferred, because it increases the surface area for heat loss considerably. Thus the cooling is better ensured and it may even reduce the length of the conduit needed.

The second separation step is preferably a centrifugal separation step. The cyclone needed for this centrifugal separation step is generally much smaller than the one used for the centrifugal separation step.

When the present process is applied in an FCC process, the agglomerates that are being formed are preferably at least 3 micrometer and up to 50 micrometer in diameter. In other situations, agglomerates up to 100 micrometer may be formed. The particles itself that form the agglomerates are much smaller. The particles itself are generally between 0.1 and 15 micrometer, more preferably between 0.1 and 5 micrometer, even more preferably between 0.1 and 2 micrometer. The particles-rich flow that enters the second separation step preferably contains in the range from 3000 to 10000 mg/Nm$^3$ particles, more preferably in the range from 5000-8000 mg/Nm$^3$ particles.

Applicants found that separation is furthermore improved if the formed agglomerates remain intact, by transporting them from the cyclone separation step to the second separation step in an uninterrupted flow. Thus preferably, the particles-rich underflow is passed along a smooth conduit to the second separation step. With a smooth conduit is meant that the conduit is substantially free of obstacles and the agglomerates and particles flow substantially free of subjecting them to impact forces. Impact forces break up the formed agglomerates, and the agglomerated solids will remix. Blinded Tee bends (being an abrupt 90 degree bend, with a cushioning vertical but closed pipe extension), valves and nozzles in the conduit are examples of arrangements that have an impact force.

In the process of the invention particles are being separated from a particles-containing gas stream, to obtain a flue gas having a low solids content. Preferably, the gas flow leaving the second separation step contains at most 500 mg/Nm$^3$ particles. The stream to the stack combines the gas rich flow and the gas flow coming from the second separation step. Preferably, the combined stream to the stack contains at most 50 mg/Nm$^3$ particles.

The separation process as described above can be applied in any field where small particles need to be separated from a gas-solids stream. It can for example be applied in coal gasification and coal combustion for power generation. Preferably, the separation process as described above is used in a fluid catalytic cracking (FCC) process. Preferably, the particles-containing gas stream is a gas stream coming from a regenerator, the gas stream containing fluid catalytic cracking catalyst fines. Thus in this case the particles are catalyst fines that are formed in the fluid catalytic cracking process. The fines are preferably in the range of between 0.1 and 15 micrometer, more preferably between 0.1 and 5 micrometer, even more preferably between 0.1 and 2 micrometer.

The present invention furthermore provides an assembly comprising a cyclone separator having an inlet for receiving a particles-containing gas stream, a gas outlet for a gas rich flow and a solids outlet for a particles-rich flow, and a second separator, having an inlet for receiving the particles-rich flow from the cyclone separator, wherein between the inlet of the second separator and the solids outlet of the cyclone separator a conduit with a cooling unit is present.

The cooling unit can be any unit that is capable of cooling a gas, known to the skilled person. Examples of such cooling units are various types of heat exchangers, extended conduits or conduits with finned piping. Preferably, the cooling unit is an extended conduit which conduit is subjected to ambient temperatures. With ambient temperatures is meant the temperature of the open air. This temperature depends on the location of the assembly and may vary between 60° C. and −50° C. With extended conduit a longer conduit than usual between the cyclone separator and the second separator is meant. The length depends on the distance between the cyclone separator and the second separator in the actual layout of the plant where the assembly is being used. The minimum length of the conduit is determined by heat transfer calculations taking into account ambient temperature and wind conditions. Preferably, the extended conduit has a length of at least 30 meters, more preferably of at least 40 meters, even more preferably of at lest 50 meters.

Another way to increase the cooling surface is by using a finned pipe as conduit. The fins provide extra surface for heat exchange with the ambient temperature. As the skilled person will know, more options may be available, like for example a system similar to a heat exchanger.

The conduit between the cyclone separator and the second separator, may have bends. In the case these bends are present, the radius of the curvature of the central longitudinal axis of the bend is preferably at least 3 times the diameter of the conduit, more preferably at least 5 times the diameter of the conduit. Preferably, the conduit is helically shaped.

A further advantage of the decrease in temperature is that a lower volumetric gas flow rate is obtained. With a lower volumetric gas flow rate, smaller equipment can be used. In addition, a lower volumetric gas flow rate at a constant solids flow rate results in a higher dust concentration. The higher the dust concentration, the higher the efficiency of the cyclone separator becomes. When the dust concentration to the second separator is larger, there is a higher chance that very small particles get trapped in between large particles in the second separator. Hence, the very small particles that would not normally be captured by a cyclone will get separated if the dust concentration is high enough.

The conduit arranged to transport the particles between the separators is preferably substantially free from features that subject the particles to impact forces. Impact forces may break up the formed agglomerates, and the agglomerated solids will remix. Blinded Tee bends in the conduit are an example of an arrangement that has an impact force. Also valves and nozzles may form obstructions, resulting in impact forces, in the conduit between the separators. Preferably, the conduit is substantially free of valves or nozzles. The nozzle that is used to control the amount of gas that is present in the particles-rich flow is generally called the Critical Flow Nozzle (CFN). Suitably, it is adjusted that in the range of from 2 wt % up to 10 wt %, more suitably in the range from 2 wt % up to 5 wt % of the total amount of gas present in the particles-containing gas stream is present in the particles-rich flow and that the rest is in the gas rich flow. Preferably, the critical flow nozzle (CFN) is placed downstream the second separator, to avoid disturbance of the flow so that formed agglomerates remain intact. In addition, in the case the second separator is a cyclone, locating the CFN downstream the cyclone will ensure a smaller cyclone and less erosion on the CFN due to lower dust loads as compared to the conduit.

The assembly as described above can be applied in any field where small particles need to be separated from a gas-solids stream. It can for example be applied in coal gasification and coal combustion for power generation. Preferably, the assembly as described above is used in a fluid catalytic cracking (FCC) plant just after the regenerator, thus receiving the regenerator flue gas.

When the assembly as described above is used in a fluid catalytic cracking (FCC) plant just after the regenerator, the cyclone separator is preferably a third stage separator and the second separator is preferably a fourth stage separator. Preferably, the third stage separator is a vessel that contains numerous swirl tube separators. These swirl tube separators are small axial flow cyclones. Flue gas entering the separator tube passes through the swirl vanes that imparts a spinning motion to the gas flow. Applicants found that agglomeration already starts at the vanes of the swirl tube separators; and by having a free flow to the bottom-outlet of the TSS-vessel, and from there an uninterrupted flow to the FSS, the agglomeration will remain undisturbed. An example of such a third stage swirl tube separator is described in EP-A-360360. The cyclone separator is preferably equipped with a vortex stabilizer. The vortex stabilizer may comprise a vortex stabilizer plate and a vortex finder rod. An example of such a vortex stabilizer is given in EP-A-360360. The presence of the vortex stabilizer improves both the separation efficiency and pressure drop across the cyclone. The vortex stabilizer ensures that the vortex is always centralized in the cyclone, hence improves the separation efficiency. The vortex stabilizer also ensures that the vortex does not extend to the bottom of the cyclone and into the dipleg. If this happens, separated fines at the bottom of the cyclone may be re-entrained, deteriorating the separation efficiency. The swirl tube separator may also be equipped with a vortex extender pin, or with a combination of a vortex stabilizer with a vortex extender pin. The vortex extender pin is described in more detail in WO-A-2004009244. The TSS with the vortex extender pin technology has as important aspect that the gas underflow may be restricted from the current >3 wt % to <2 wt %, in fact meaning a reduction by a factor of at least 1.5. The dust content, being the same in amount, increases with that same factor on concentration. Applicants found that an increased concentration will be beneficial for cyclone-separation, as particles will move closer to each other and smaller particles are better separated in the wake zone of larger particles. Furthermore, applicants found that when the particles move closer, even more agglomerates are being formed with the use of the vortex extender pin.

The fourth stage separator (FSS) is preferably a cyclone separator. This cyclone is generally much smaller than the TSS. The cyclone separator is preferably equipped with a vortex stabilizer, more preferably with a vortex stabilizer with a vortex pin, which vortex pin more preferably may be extended.

FIG. 1 shows a schematic representation of a fluid catalytic cracking flue gas cleaning system wherein a preferred embodiment of the assembly according to the present invention is integrated.

Referring now to FIG. 1, in the regenerator (1) fluid catalytic cracking catalyst is regenerated. The flue gas that is produced in this regeneration step is transferred via stage cyclones (2) and via conduit (3) to the TSS (4). The flue gas comprises catalyst fines that need to be separated from the gas because of environmental regulations. The TSS (4) is equipped with swirl tube separators (5). The gas rich flow is transferred via conduit (6) to the stack (13). The particles-rich flow is transferred via cooling unit (7) to the FSS (8). In the FSS (8) the particles are further separated from the gas that is still present. The particles are collected in a fines hopper (9) and are disposed via disposal conduit (10). The gas leaving the FSS is transferred via a conduit with a CFN (11). The gas rich flow and the gas flow from the FSS (8) are combined and transferred via conduit (12) to the stack (13).

The invention is furthermore illustrated by the following example.

EXAMPLE

To calculate the effect of agglomeration on the separation efficiency after the second separation step, data were collected from actual measurements from a FCC plant. The particle distribution of the particles (catalytic cracking catalyst fines) present in the flue gas coming from the regenerator of an FCC plant was measured and used as input for the model to calculate the separation.

The calculation was based on the line-up as shown in FIG. 1, the line-up comprising a TSS being a Shell TSS having a d50 of 1.8 micrometer, a FSS and a CFN in the overflow of the FSS. (The term 'd50' refers to the diameter in microns of a dust particle which has a 50% chance of being caught by the cyclone.) The total measured amount of particles in the particles-containing gas stream entering the TSS is 220 mg/Nm$^3$. The CFN was adjusted such that 3% of the gas entering the TSS ended up in the particles-rich flow and 97% of such gas ended up in the gas rich flow. At the TSS-outlet the amount of particulates in the gas-rich flow was measured at 35 mg/Nm$^3$. The particles-rich flow coming from the TSS has a particles concentration of 6600 mg/Nm$^3$. The FSS cyclone has a typical cut-point (d50) of 4 microns.

COMPARATIVE EXAMPLE

No Cooling

The outlet of the TSS is set at 700° C. When no cooling is applied when the particles-rich flow enters the FSS cyclone, the calculated emission to the stack of the FSS outlet is 646 mg/Nm3. The combined emission to the stack of the TSS and the FSS is the sum of 97% of 35 (from TSS) combined with 3% of 646 mg/Nm3 is 53.3 mg/Nm$^3$.

EXAMPLE 1

Cooling

By applying the process according to the invention, the conduit from the TSS to the FSS is cooled from 700° C. to 400° C. This results in a calculated emission to the stack of the FSS outlet of 486 mg/Nm$^3$. This is a reduction of 24.8%. The combined emission to the stack of the TSS and the FSS is the sum of 97% of 35 (from TSS) combined with 3% of 486 mg/Nm$^3$ is 48.5 mg/Nm$^3$.

Thus the separation efficiency of the FSS cyclone as a result of agglomerate formation and stabilization and as a result of the improved FSS cyclonic efficiency at lower temperatures, has improved to a large extent. The importance of this improvement is that the emission to stack is dropped considerably. With cooling the emission to stack is below the critical value of 50 mg/Nm$^3$.

That which is claimed is:

1. A process to separate particles from a particles-containing gas stream containing particles having a size in the range of from 0.1 to 15 micrometers wherein the process comprises: subjecting the particles-containing gas stream to a centrifugal separation step, whereby the particles-containing gas stream is separated into a gas rich flow and a particles-rich flow; cooling the particles-rich flow having a temperature in the range from 600 to 800° C. to provide a cooled particles-rich flow having a temperature in the range from 200 to 450° C.; and subjecting the cooled particles-rich flow to a second separation step, whereby particles are separated from the cooled particles-rich flow to thereby provide a gas flow having low solids content and separated particles.

2. A process according to claim 1, wherein the second separation step is a centrifugal separation step.

3. A process according to claim 1, wherein the particles-containing gas stream contains in the range from 3000 to 10000 mg/Nm$^3$ particles.

4. A process according to claim 1, wherein the particles-rich flow is passed along a smooth conduit to the second separation step.

5. A process according to claim 1, wherein the particles-containing gas stream is from a regenerator of a fluid catalytic cracking unit and wherein the particles include fluid catalytic cracking catalyst fines.

6. An assembly, comprising: a cyclone separator having a first inlet for receiving a particles-containing gas stream, a gas outlet for a gas rich flow and a solids outlet for a particles-rich flow; a second separator, having a second inlet for receiving the particles-rich flow from the cyclone separator; and, between the second inlet of the second separator and the solids outlet of the cyclone separator, a cooling unit.

7. An assembly according to claim 6, wherein the cooling unit is a conduit comprising finned piping.

8. An assembly according to claim 7, wherein the conduit is arranged to transport the particles-rich flow substantially free of subjecting the particles therein to impact forces.

9. An assembly according to claim 7, wherein the conduit is substantially free of valves or nozzles.

10. An assembly according to claim 7, wherein the conduit is helically shaped.

11. An assembly according to claim 7, wherein the conduit has one or more bends wherein each one or more bends has a radius of at least 3 times the diameter of the conduit.

12. An assembly according to claim 7, wherein the second separator is a cyclone separator.

13. Process according to claim 1, wherein the particles-containing gas stream contains in the range from 5000-8000 mg/Nm$^3$ particles.

* * * * *